US010062503B2

(12) United States Patent
Nagata et al.

(10) Patent No.: US 10,062,503 B2
(45) Date of Patent: Aug. 28, 2018

(54) MANUFACTURING METHOD OF GREEN COMPACTS OF RARE EARTH ALLOY MAGNETIC POWDER AND A MANUFACTURING METHOD OF RARE EARTH MAGNET

(71) Applicant: XIAMEN TUNGSTEN CO., LTD., Xiamen, Fujian (CN)

(72) Inventors: Hiroshi Nagata, Xiamen (CN); Chonghu Wu, Xiamen (CN)

(73) Assignee: XIAMEN TUNGSTEN CO., LTD., Xiamen (CN)

( * ) Notice: Subject to any disclaimer, the term of this patent is extended or adjusted under 35 U.S.C. 154(b) by 440 days.

(21) Appl. No.: 14/435,017

(22) PCT Filed: Oct. 11, 2013

(86) PCT No.: PCT/CN2013/085035
§ 371 (c)(1),
(2) Date: Apr. 10, 2015

(87) PCT Pub. No.: WO2014/056447
PCT Pub. Date: Apr. 17, 2014

(65) Prior Publication Data

US 2015/0287529 A1 Oct. 8, 2015

(30) Foreign Application Priority Data

Oct. 11, 2012 (CN) ..... 2012 1 0387820
Oct. 11, 2012 (CN) ..... 2012 1 0390077

(51) Int. Cl.

| | |
|---|---|
| ***H01F 41/02*** | (2006.01) |
| ***B22F 3/12*** | (2006.01) |
| ***H01F 1/057*** | (2006.01) |
| ***C22C 38/00*** | (2006.01) |
| ***C22C 38/10*** | (2006.01) |
| ***B22F 3/14*** | (2006.01) |
| ***B22F 3/24*** | (2006.01) |
| ***H01F 1/08*** | (2006.01) |

(52) U.S. Cl.
CPC ..... *H01F 41/0266* (2013.01); *B22F 3/14* (2013.01); *B22F 3/24* (2013.01); *C22C 38/002* (2013.01); *C22C 38/005* (2013.01); *C22C 38/10* (2013.01); *H01F 1/0576* (2013.01); *H01F 1/0577* (2013.01); *H01F 1/08* (2013.01); *B22F 2003/248* (2013.01); *B22F 2999/00* (2013.01); *C22C 2202/00* (2013.01)

(58) Field of Classification Search
CPC ..... H01F 41/0266; H01F 1/0576
See application file for complete search history.

(56) References Cited

U.S. PATENT DOCUMENTS

| | | | | |
|---|---|---|---|---|
| 6,261,515 | B1 | 7/2001 | Ren et al. | |
| 6,461,565 | B2 * | 10/2002 | Tokuhara | B22F 3/02 419/28 |
| 2002/0006347 | A1 * | 1/2002 | Tokuhara | B22F 3/02 419/38 |

FOREIGN PATENT DOCUMENTS

| | | | | |
|---|---|---|---|---|
| CN | 1272214 | A | | 11/2000 |
| CN | 101266856 | A | | 9/2008 |
| CN | 101819841 | A | * | 9/2010 |
| CN | 102610347 | A | | 7/2012 |
| CN | 102930974 | A | | 2/2013 |
| CN | 102945747 | A | * | 2/2013 |
| JP | 2002088403 | A | | 3/2002 |

* cited by examiner

*Primary Examiner* — Colleen P Dunn
*Assistant Examiner* — Jeremy Conrad Jones
(74) *Attorney, Agent, or Firm* — Rabin & Berdo, P.C.

(57) ABSTRACT

The present invention discloses a manufacturing method of green compacts of rare earth alloy magnetic powder and a manufacturing method of rare earth magnet, it is a manufacturing method that pressing the rare earth alloy magnetic powder added with organic additive in a closed space filled with inert gases to manufacture the green compacts, wherein the rare earth alloy magnetic powder is compacted under magnetic field in a temperature atmosphere of 25° C.-50° C. and a relative humidity atmosphere of 10%-40%. This method is to set the temperature of the inert atmosphere in a fully closed space, inhibiting bad forming phenomenon of the magnet with low oxygen content (broken, corner-breakage, crack) after sintering, and increasing the degree of orientation, Br and (BH)max.

6 Claims, No Drawings

MANUFACTURING METHOD OF GREEN COMPACTS OF RARE EARTH ALLOY MAGNETIC POWDER AND A MANUFACTURING METHOD OF RARE EARTH MAGNET

FIELD OF THE INVENTION

The present invention relates to magnet manufacturing method, especially to a manufacturing method of green compacts of rare earth alloy magnetic powder and a manufacturing method of rare earth magnet.

BACKGROUND OF THE INVENTION

Rare earth magnet is based on intermetallic compound R2T14B, thereinto, R is rare earth element, T is iron or transition metal element to replace iron or part of iron, B is boron, it is known as king of the magnet with excellent magnetic properties, the max magnetic energy product is ten times higher than that of the ferrite magnet, besides, the rare earth magnet has well machining property, the operation temperature can reach 200° C., it is hard, stable, with well cost performance and wide applicability.

There are two types of rare earth magnets depending on the manufacturing method: sintered magnet and bonded magnet. Sintered magnet has wide applications. In existing known technology, sintering method of rare earth magnet is normally performed as follows: raw material preparing→melting→casting→hydrogen decrepitaiton→micro grinding→pressing under magnetic field→sintering→heat treatment→magnetic property evaluation→oxygen content evaluation of the sintered magnet.

The process of pressing the sintered rare earth magnet under magnetic field is applied with a forming method called two-stage digestion process, which is widely used in the early time, the method is applied with a simple module mold that the magnet is formed under a low pressure (about 0.2 ton/cm$^2$) magnetic filed (the first stage of process), taken out manually and packaged, then it is formed by isostatic pressing under oil high pressure (1.4 ton/cm$^2$) (the second stage of process), as the isostatic pressing forming is using manual method, it takes long time in this process, oil pollution after forming and oxidation during transportation will cause quality management problems of the products.

To solve above problems, recently used is one-stage process, that is to say, it is applied with a transverse magnetic field orientation type—one-stage automatic pressing machine. Compared to the two-stage digestion process, one-stage forming (the maximum forming pressure is about 0.8 ton/cm$^2$) has weak forming pressure, broken, corner-breakage or crake frequently happen to the sintered magnet. Besides, during one-stage forming, the initial pressure raises to 0.6~0.80.8 ton/cm$^2$, compared to two-stage forming (the pressure of the first stage is 0.2 ton/cm$^2$), as time goes on, the degree of orientation is worse and worse, leading to decreasing of degree of orientation and low Br, (BH)max of the products.

Disclosed in U.S. Pat. No. 6,461,565 is a transverse magnetic field orientation type—one-stage automatic pressing machine, however, due to the limited technology at that time, fully sealing technology is not grade, the oxygen content during forming is controlled below 10000 ppm, spark happens during forming, so that this invention's main improvement point is to prevent unqualified products due to burning or heating of green compacts, researchers found that, controlling the compacting temperature below 5~30° C. and the humidity in 40~65% can prevent rapid oxidation due to burning or heating. In the specification of the U.S. Pat. No. 6,461,565, automatic mechanical operation device needs frequency maintenance, which can not ensure leak-proofness, thus making oxidation more easily happens. During forming, the oxygen content and the relative humidity are high, so that this method obtains sintered magnet with oxygen content over 2900 ppm, so that sintered products with lower oxygen content and better magnetic property can not be obtained.

With the development of the technology, existing nitrogen or inert jet stream replacement technology can simply realize fully sealing to obtain sintered magnet with lower oxygen content. Therefore, the producers focus on the relative technology of transverse magnetic field orientation type—one-stage automatic pressing machine based on fully sealing technology, however, broken, corner-breakage, crack and other bad problems frequently happen to the sintered magnet when adding nitrogen or inert gas to the fully sealing pressing machine. The reasons are that the nitrogen or inert gas has very low oxygen content and very low relative humidity, for example, pure nitrogen contains almost none of water when in low dew point of below −60° C., the atmosphere of the pressing machine is situated in an ultra-dry condition with relative humidity below 3%. This ultra-dry condition easily builds up static, the static electricity makes the powder produce strong electrostatic repulsion leading to bad forming property, it also leads to decreasing of degree of orientation and the Br, (BH)max. The reason is that if the surface of the powder has no oxygen and water, it will be solid like metal binding, the frictional resistance of the powder increases, leading to decreasing of degree of orientation.

Besides, when adding inert gas into the atmosphere of the fully sealing pressing machine, if forming in a low oxygen content and low humidity, abnormal grain growth (AGG) or reduced coercive force easily happens. Moreover, the low oxygen content in sintered magnet may cause failed HAST experimental result. The reason is that, no oxidant exists in the ultra-low oxygen content and ultra-low humidity condition, no-oxidation metal Nd increases, abnormal grain growth (AGG), reduced coercive force and failed HAST experimental result easily happen.

SUMMARY OF THE INVENTION

The object of the present invention is to overcome the disadvantages of the existing known technology, and to provide a manufacturing method of green compacts of rare earth alloy magnetic powder with low-medium oxygen content, therein the temperature and humidity of the closed space with inert gases are specially set that can inhibit the negative phenomenon like broken, corner breakage or crack of the low-medium oxygen content magnet green compacts after sintering and thus improving the orientation, Br and (BH) max.

The technical proposal of the present invention is that:

A manufacturing method of green compacts of rare earth alloy magnetic powder, it is a manufacturing method that pressing the rare earth alloy magnetic powder with organic additive in a closed space filled with inert gases to manufacture the green compacts, wherein the rare earth alloy magnetic powder is pressed under magnetic field in a temperature atmosphere of 25° C.-50° C. and a relative humidity atmosphere of 10%-40%, the rare earth alloy magnetic powder is made by following method: cooling the rare earth molten alloy in a cooling rate between 100° C./s and 10000° C./s to get rapid solidified alloy, then getting the rapid solidified alloy hydrogen decrepitation, using a fine-crusher to obtain the powder, the fine-crusher has controllable concentration of the oxide gas in the pulverizing room, the oxide gas is oxygen and/or water, the concentration is below 100 ppm.

The relative humidity in the present invention is measured in above pressing temperature and normal pressure condition.

The organic additive in the present invention is the totally name of antioxidant, molding promoter and mould lubricant that can be bought in the market.

Technology of rapid solidified alloy+hydrogen decrepitation to get rare earth alloy magnetic powder has came, the fine-crusher changes its function, with rapid solidified alloy+hydrogen decrepitation, very small crack, looseness exist in the raw material, the pulverizing mechanism of the fine-crusher changes as well. There is a general belief that air-blast pulverizing needs high content water and oxygen. The inventors are focusing on how to improve the powder for once forming. So that, powder with oxygen and/or water content below 100 ppm is used as the pulverizing powder. Compared to the traditional technology, the present invention is provided with powder with low oxygen content and low water content that can be once formed in a relative humidity of 10~40% and a temperature of 25° C.~50° C. The present invention can improve the magnet property and reduce unqualified products.

The present invention sets temperature in an available range of 25° C.~50° C., it changes the organic additive's character and removes electrostatic to make it softened and liquid, inhibits bad compacting phenomenon (broken, corner-breakage, crack) after sintering, and increases the degree of orientation, Br and (BH)max; on the other hand, raising the temperature can improve the liquidity of the organic additive that making it exploiting the lubricant performance nicely, thus increasing the degree of orientation, Br, (BH) max. Besides, the present invention controls the relative humidity of inert atmosphere in the range of 10%~40% that can remove the electrostatic of the powder in the closed space, thus weakening the electrostatic repulsion of the powder.

It has to be noted that if the temperature exceeds 50° C., it would lead to increasing of unqualified products rate, reducing magnetic property and increasing the oxygen content of sintered magnet. The reason is that, the organic additive is reacted with the powder, the oxygen component, the carbon component and the hydrogen component decomposes and reacts with the rare earth metal. By this reactions, the oxygen content of the magnet increases, thus leading to bad sintering and thus low magnet property.

On the other hand, green compacts formed in a low temperature below 25° C. will make it with bad coercivity and squareness after sintering, the reason is that in the green compacts, the dispersity of the organic additive is bad, it will form lumps. If the organic additive forms lumps, it will react violently with the R rich phase around the lumps, so that the R rich phase will get metamorphic to be carbide, thus reducing the coercivity. Above said situation can explain the HAST (weightlessness) experiment result, the carbide reacting with the organic additive with lumps will react violently with the water in the HAST experiment, making it disrupted and fell from the grain boundary, thus increasing the weightless value.

It has to be noted that in the present invention, defining the forming temperature, the atmosphere temperature of the inert gas of the pressing machine is similar to the mold temperature and powder temperature, the reason is that, the heat of the atmosphere will get on the mold and the powder as time goes on. Therefore, the atmosphere temperature can substitute the mold temperature and the powder temperature.

In another preferred embodiment, the rare earth alloy magnetic powder is NdFeB series rare earth alloy magnetic powder.

In another preferred embodiment, the rare earth alloy magnetic powder is formed under magnetic field in an inert jet stream with a relative humidity 20%-35%, a temperature 31° C.-45° C. and oxygen concentration below 1000 ppm. The relative humidity is controlled in a range of 15%-30%, so that it can remove most electrostatic, the 31° C.-45° C. atmosphere temperature can sufficiently improve the organic additive to exploit the lubricant performance so as to make better green compacts, a medium-low oxygen content and high performance magnet with high degree of orientation, Br, (BH)max is obtained in an inert jet stream atmosphere with oxygen content below 1000 pp.

The inert gases can be argon, helium, krypton, nitrogen or $CO_2$ that being inert to the rare earth alloy powder.

In another preferred embodiment, the organic additive is at least one of mineral oil, synthetic oil, animal and vegetable oil, organic esters, paraffin, polyethylene wax, modified wax, the weight ratio of the organic additive and the rare earth alloy magnetic powder is 0.01~1.5:100.

The organic additives have following common features:

1. It is of well coating performance, stable in normal temperature, indecomposable but volatile in medium temperature;

2. After added to the powder, the organic additive liquid or solid at normal temperature can be formed solid thin film on the surface of the powder of irregular shape, so that the powder forms like ball, it can delay the powder taking oxygen in, the powder particles can rotate along the magnetization direction when orientating, thus increasing the degree of orientation and the dispersion of the powder, removing the electrostatic of the grinding cavity and the powder, the powder will not easily caking, thus making the powder particles even in diameter;

3. Small particles are easily oxidized, the organic additive can prevent that.

In another preferred embodiment, the organic esters are methyl caprylate. In the temperature and the humidity condition of the present invention, the methyl caprylate has well lubricant effect, as it is of high-temperature volatilization, even the added weight is up to 1.5% of the rare earth alloy magnetic powder, a little amount of C, 0 is left in the sintered magnet, compared to ordinary additive, it can not only well perform its lubricant property, increase the degree of orientation and forming property, but also ensure the Br, Hcj and (BH)max not to be influenced.

Another object of the present invention is to provide a manufacturing method of rare earth magnet.

A manufacturing method of rare earth magnet, wherein the method comprises: pressing the rare earth alloy magnetic powder with organic additive in a closed space filled with inert gases in a temperature atmosphere of 25° C.-50° C. and a relative humidity atmosphere of 10%-40% to manufacture the green compacts, then sintering the green compacts, the rare earth alloy magnetic powder is made by following method: cooling the rare earth molten alloy in a cooling rate between 100° C./s and 10000° C./s to get rapid solidified alloy, then getting the rapid solidified alloy hydrogen decrepitation, using a fine-crusher to obtain the powder, the fine-crusher has controllable concentration of the oxide gas in the pulverizing room, the oxide gas is oxygen and/or water, the concentration is below 100 ppm.

1) the present invention is provided to obtain finished high property sintered magnet with oxygen content below 2500 ppm that rare earth alloy magnetic powder is firstly pressed to be magnet in an inert gas atmosphere with low oxygen content and in a medium-low relative humidity.

2) in the magnetic field forming process, in inert gas atmosphere and closed space, the inert gas atmosphere has a temperature in an available range of 25° C.~50° C. and a relative humidity of 10%-40%, this method is to set the temperature of the inert atmosphere in a fully closed space, and changing the organic additive's character to make it softened and liquid, removing the electrostatic, inhibiting bad forming phenomenon of the magnet with low oxygen content (broken, corner-breakage, crack) after sintering, and increasing the degree of orientation, Br and (BH)max; on the other hand, raising the temperature can improve the liquidity of the organic additive that making it exploiting the lubricant performance nicely, thus increasing the degree of orientation, Br, (BH)max. Besides, the present invention controls the relative humidity of inert atmosphere in the range of 10%-40% that can remove the electrostatic of the powder in the closed space, thus inhibiting bad forming phenomenon like broken, corner-breakage, crack of the sintered magnet.

3) It is found that, appropriate amount of water is served as lubricant that can increase the degree of orientation and Br, (BH)max, adding water to the pressing machine can improve the magnetic property (Br, (BH)max, Hcj), it can also improve anti-corrosion performance.

DETAILED DESCRIPTION OF THE EMBODIMENTS

The present invention will be further described with the embodiments.

First Embodiment

The present invention takes NdFeB rare earth alloy magnetic powder for example to describe the pressing process under the magnetic field.

The method includes following manufacturing flow: raw material preparing→smelting→casting→hydrogen crushing→micro grinding→pressing under magnetic field→sintering→heat treatment→magnetic property evaluation→oxygen content evaluation of the sintered magnet.

In the raw material preparing process: preparing Nd with 99.5% purity, industrial Fe—B, industrial pure Fe, Co with 99.9% purity, the weight ratio of the components is shown in TABLE 1.

TABLE 1

| The weight ratio of the components | | | |
|---|---|---|---|
| Nd | Fe | B | Co |
| 30.5 | 68 | 1 | 0.5 |

Based on above weight ratio, 500 Kg raw material is prepared.

In melting process: the prepared raw materials are put into a crucible made of aluminum oxide, using a high frequency vacuum induction melting furnace to vacuum smelt the raw materials to 1500° C. in a $10^{-2}$ Pa vacuum.

In casting process: Ar gas is filled to the melting furnace to $10^{-2}$ Mpa after vacuum melting, then centrifugal casting method is used to cast in order to get rapid solidified alloy in a cooling rate of 1000° C./s~3000° C./s.

In hydrogen decrepitation process: the crushing room with rapid solidified alloy is pumped at room temperature, then filling with hydrogen with 99.5% purity to 0.1 Mpa, leave for 2 hours, after that, heating the crushing room and pumping at the same time, then keeping vacuum in 500° C. for 2 hours, then cooling it, getting the crushed specimen out.

In micro grinding process: at an atmosphere with oxidizing gas below 100 ppm, the pressure of the crushing room is 0.4 Mpa, the crushed specimen is then grinded by air-flow mill, the average particle size of the grinded powder is 3.4 μm. The oxidizing gas is oxygen and/or hydrogen.

Adding methyl caprylate to the grinded powder, the additive amount is 0.2% of the weight of the rare earth alloy magnetic powder, the mixture is well blended by V-type mixer.

In pressing under magnetic field process: dividing the powder into 10 equal parts, using a right orientation type magnetic filed molding, each part is then formed to a cube with edge 25 mm in an 1.8 T of orientation filed and 0.6 ton/cm$^2$ of forming pressure, then the cubes get demagnetization in 0.2 T magnetic filed.

It is formed in argon atmosphere, the oxygen content stays below 1000 ppm, the forming machine is configured with humidifier and cooling device, it is formed in a temperature vibration range of 10° C.~55° C. and a relative humidity vibration range of 5~45%. The pure inert gas is filled to the fully closed space, bits of leakage may happen that leading to temperature and humidity different (for example, cooling water is provided in the magnetic filed generator of the magnetic field molding, the water from the seam of the cooling water and the condensation water will influence the humidity. Besides, the window of the magnetic filed pressing machine is applied with resin plate, the glove is made of rubber, outside air is easily permeated in, that also influence the humidity controlling), therefore, humidifier and cooling device are applied to control the humidity.

In the examination of corner-breakage of green compacts: permanent magnet material is unqualified if there is even a little bit corner-breakage, by visual inspection, if broken, corner breakage or crack having more than 3 mm length is found, it is unqualified. In the sintering progress: the formed bodies are moved to the sintering furnace to sinter, in a vacuum of $10^{-2}$ Pa for 2 hours in 200° C. and for 2 hours in 900° C., then sintering for 2 hours in 1050° C., after that filling in Ar gas to 0.1 MPa, cooling to room temperature.

In the heating progress, the sintered magnet is heated for 1 hour in 580° C. in high purity Ar gas, then cooling it to room temperature and get it out.

In magnetic property evaluation progress: the sintered magnet is tested by NIM-10000H nondestructive testing of large rare earth permanent magnet of China metrology institute, the testing temperature is 20° C.

In the oxygen content of sintered magnet evaluation progress: the oxygen content of the sintered magnet is tested by EMGA-620W oxygen and nitrogen analyzer of Japan HORIBA company.

In corner-breakage and crash of sintered magnet examination progress: a permanent magnet is unqualified if there is even a little bit of corner-breakage or crash, by visual inspection, any corner-breakage or crash of the green compacts longer than 3 mm is determined to be unqualified, calculating the failure rate consolidating with the unqualified products during forming.

TABLE 2 shows magnetic property comparison between the first embodiment and a comparing sample (formed in different temperatures).

TABLE 2 magnetic property comparison

| Serial No | Relative Humidity (%) | Temperature inside the machine (° C.) | Failure Rate (%) | Br (kGs) | Hcj (kOe) | SQ (%) | (BH)max (MGOe) | HAST weightlessness (mg) | Oxygen Content of the Sintered magnet (ppm) |
|---|---|---|---|---|---|---|---|---|---|
| 1 | 5 | 10 | 32 | 13.9 | 13.2 | 87.5 | 42.3 | 42.8 | 285 |
| 2 | 6 | 15 | 22 | 13.9 | 13.3 | 87.6 | 42.1 | 20.7 | 280 |
| 3 | 8 | 20 | 3 | 14 | 13.4 | 88 | 43.1 | 10.5 | 287 |
| 4 | 10 | 25 | 0 | 14.3 | 14.9 | 97.7 | 50.0 | 3 | 300 |
| 5 | 15 | 30 | 0 | 14.4 | 14.9 | 97.8 | 50.7 | 2.9 | 332 |
| 6 | 20 | 31 | 0 | 14.6 | 15.2 | 98.1 | 52.3 | 2.8 | 459 |
| 7 | 30 | 40 | 0 | 14.6 | 15.2 | 97.8 | 52.0 | 2.6 | 589 |
| 8 | 35 | 45 | 0 | 14.6 | 15.1 | 97.6 | 51.8 | 2.5 | 674 |
| 9 | 40 | 50 | 0 | 14.5 | 15.1 | 98.3 | 51.6 | 2.3 | 920 |
| 10 | 45 | 55 | 19 | 13.9 | 11.4 | 78.5 | 38.0 | 102.5 | 2820 |

Second Embodiment

The second embodiment has following differences from the first embodiment:

1) the organic additive added to the grinded powder is methyl caprylate, the amount is 0.2% of the weight of the rare earth alloy magnetic powder, the mixture is well blended by V-type mixer.

2) In pressing under magnetic field process: dividing the powder into 10 equal parts, using a right orientation type magnetic filed molding, each part is then compacted to a cube with edge 25 mm in an 1.8 T of orientation filed and 0.8 ton/cm$^2$ of forming pressure, then the cubes get demagnetization in 0.2 T magnetic filed.

It is formed in argon atmosphere, the oxygen content stays below 1000 ppm, the forming machine is configured with humidifier and cooling device, it is formed in a temperature vibration range of 10° C.~55° C. and a relative humidity vibration range of 5~45%.

TABLE 3 shows magnetic property comparison between the second embodiment and a comparing sample (formed in different temperatures).

Third Embodiment

The third embodiment has following differences from the first embodiment:

1) the organic additive added to the grinded powder is methyl caprylate, the amount is 1.5% of the weight of the rare earth alloy magnetic powder, the mixture is well blended by V-type mixer.

2) In pressing under magnetic field process: dividing the powder into 10 equal parts, using a right orientation type magnetic filed molding, each part is then compacted to a cube with edge 25 mm in an 1.8 T of orientation filed and 0.3 ton/cm$^2$ of forming pressure, then the cubes get demagnetization in 0.2 T magnetic filed.

It is formed in argon atmosphere, the oxygen content stays below 1000 ppm, the forming machine is configured with humidifier and cooling device, it is formed in a temperature vibration range of 10° C.~55° C. and a relative humidity vibration range of 5~45%.

TABLE 4 shows magnetic property comparison between the third embodiment and a comparing sample (formed in different temperatures).

TABLE 3 magnetic property comparison

| Serial No | Relative Humidity (%) | Temperature inside the machine (° C.) | Failure Rate (%) | Br (kGs) | Hcj (kOe) | SQ (%) | (BH)max (MGOe) | HAST weightlessness (mg) | Oxygen Content of the Sintered magnet (ppm) |
|---|---|---|---|---|---|---|---|---|---|
| 1 | 5 | 10 | 25 | 12.8 | 12.8 | 85.2 | 35.2 | 50.6 | 347 |
| 2 | 6 | 15 | 12 | 12.9 | 12.9 | 85.2 | 35.4 | 32.5 | 326 |
| 3 | 8 | 20 | 1 | 13.1 | 13.0 | 88 | 41.4 | 8.9 | 338 |
| 4 | 10 | 25 | 1 | 14.0 | 14.7 | 96.5 | 47.3 | 3.5 | 550 |
| 5 | 15 | 30 | 1 | 14.0 | 14.8 | 96.6 | 47.3 | 3.3 | 582 |
| 6 | 20 | 31 | 0 | 14.5 | 14.8 | 97.1 | 51.0 | 3.3 | 603 |
| 7 | 30 | 40 | 0 | 14.4 | 15.0 | 97.2 | 50.4 | 3.2 | 687 |
| 8 | 35 | 45 | 0 | 14.4 | 15.1 | 96.8 | 50.5 | 3.1 | 824 |
| 9 | 40 | 50 | 0 | 14.0 | 14.9 | 97.3 | 47.7 | 3.0 | 1046 |
| 10 | 45 | 55 | 35 | 13.5 | 10.3 | 70.6 | 32.2 | 142.0 | 3221 |

TABLE 4 magnetic property comparison

| Serial No | Relative Humidity (%) | Temperature inside the machine (° C.) | Failure Rate (%) | Br (kGs) | Hcj (kOe) | SQ (%) | (BH)max (MGOe) | HAST weightlessness (mg) | Oxygen Content of the Sintered magnet (ppm) |
|---|---|---|---|---|---|---|---|---|---|
| 1 | 5 | 10 | 19 | 13.5 | 13.0 | 87.4 | 40.2 | 39.8 | 265 |
| 2 | 6 | 15 | 11 | 13.8 | 13.2 | 87.5 | 41.7 | 25.6 | 252 |
| 3 | 8 | 20 | 8 | 14.1 | 13.3 | 89.0 | 44.2 | 18.5 | 280 |
| 4 | 10 | 25 | 1 | 14.2 | 14.8 | 97.5 | 49.1 | 3.5 | 295 |
| 5 | 15 | 30 | 1 | 14.5 | 14.9 | 97.6 | 51.3 | 3.0 | 312 |
| 6 | 20 | 31 | 0 | 14.5 | 15.1 | 98.0 | 52.4 | 3.0 | 423 |
| 7 | 30 | 40 | 0 | 14.6 | 15.2 | 97.9 | 52.2 | 3.6 | 550 |
| 8 | 35 | 45 | 0 | 14.5 | 15.2 | 97.8 | 52.2 | 2.8 | 626 |
| 9 | 40 | 50 | 1 | 14.6 | 15.0 | 98.1 | 52.3 | 2.9 | 720 |
| 10 | 45 | 55 | 21 | 13.6 | 11.2 | 78.2 | 36.2 | 89.5 | 2016 |

As can be seen from the third embodiment, even the added weight is up to 1.5% of the rare earth alloy magnetic powder, a little amount of C, 0 is left in the sintered magnet, so that it can well perform its lubricant property, it not only increases the degree of orientation and forming property, but also ensures the Br, Hcj and (BH)max not to be influenced.

It is important to note that SQ=Hk/Hcj in TABLE 2, TABLE 3, TABLE 4.

CONCLUSION

As can be seen from TABLE 1, TABLE 2, TABLE 3, TABLE 4, the Br, (BH)max, Hcj of the obtained sintered magnet are increased, reasons are that:

On one hand, when the atmosphere temperature exceeds 20° C., the organic addictive is softened to exercise its lubrication effect, as a result, the Br, (BH)max, Hcj of the obtained sintered magnet are significantly increased. In particular, when the atmosphere temperature exceeds 31° C., the lubrication effect is further developing, the Br, (BH)max, Hcj of the obtained sintered magnet are further increased as well.

On the other hand, the sintered magnet is formed in the magnetic field at a controlled relative humidity of 10%-40% in inert atmosphere, the proper water is served as lubricant, thus enhancing the degree of orientation and increasing the Br, (BH)max, it can also eliminate electrostatic and solve the problems of broken, corner breakage or crack of the sintering rare earth magnet.

On still another, the present invention is applied with powder of low oxygen content and low water content.

Combining above three aspects, the obtained magnet has high-performance, medium-low oxygen content and is well compacted in inert atmosphere with oxygen content below 1000 ppm, the degree of orientation, Br, (BH)max of the obtained sintered magnet are increased as well.

The reason of higher coercivity can not be explained based on existing known theory, maybe one reason is the medium-low oxygen content below 1000 ppm of the sintered magnet. As in the first embodiment, the second embodiment and the third embodiment, the magnet is compacted in medium-low oxygen content atmosphere, it can presume that the microelement C, O of the organic additive is reacted with Nd rich, and thus forming the eutectic low melting point product.

If the atmosphere temperature exceeds 50° C., the temperature is too high, during from compacting to sintering, the organic additive and the magnetic components largely react and thus forming Nd rich phase and carbide, with the increasing of the oxygen content, it forms a number of rare earth type carbide, rare earth type oxide, rare earth oxycarbide, the coercivity of the Nd rich phase is offset to stop increasing, so that the coercivity and the squareness are decreased, the HAST experimental result fails, and the Br, (BH)max are decreased.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is to obtain green compacts of rare earth alloy powder with low-medium oxygen content that the green compacts is pressed and compacted in inert atmosphere with low oxygen content and low-medium relative humidity, and finally obtained is high-performance sintered magnet with oxygen content below 2500 ppm.

The invention claimed is:

1. A method of manufacturing a green compact composed of rare earth alloy magnetic powder, the method comprising:

(a) preparing a rare earth alloy magnetic powder in a closed space by:

(i) providing a melt comprised of a rare earth alloy;

(ii) rapidly cooling the melt at a cooling rate ranging between 100° C/s and 10000° C/s to solidify the rare earth alloy;

(iii) performing hydrogen decrepitation on the solidified rare earth alloy to provide a decrepitated alloy; and (iv) crushing the decrepitated alloy using a fine crusher provided in a pulverizing room having a controlled atmosphere to obtain said rare earth alloy magnetic powder, the controlled atmosphere having a concentration of less than 100 ppm of an oxide gas comprised of at least one of oxygen and water; and (b) preparing said green compact by:

(i) pressing the rare earth alloy magnetic powder with at least one organic additive under a magnetic field in a closed space having an atmosphere comprised of at least one inert gas, having a temperature ranging from 40° C.-45° C. and a relative humidity ranging from 20%-35%, to provide said green compact.

2. The method according to claim 1, wherein the rare earth alloy magnetic powder is a NdFeB series rare earth alloy magnetic powder.

3. The method according to claim 2, wherein the atmosphere during pressing has a an oxygen concentration below 1000 ppm.

4. The method according to claim 3, wherein the organic additive is at least one of a mineral oil, a synthetic oil, an animal oil, a vegetable oil, at least one organic ester, a paraffin, a polyethylene wax, a modified wax, and wherein a weight ratio of the organic additive and the rare earth alloy magnetic powder ranges from 0.01~1.5:100.

5. The method according to claim 4, wherein the at least one organic ester is a methyl caprylate.

6. A method of manufacturing a rare earth magnet from a green compact composed of a rare earth alloy magnetic powder, the method comprising:

(a) preparing said rare earth alloy magnetic powder in a closed space by:

(i) providing a melt comprised of a rare earth alloy;

(ii) rapidly cooling the melt at a cooling rate ranging between 100° C/s and 10000° C/s to solidify the rare earth alloy;

(iii) performing hydrogen decrepitation on the solidified rare earth alloy to provide a decrepitated alloy; and (iv) crushing the decrepitated alloy using a fine crusher provided in a pulverizing room having a controlled atmosphere to obtain a rare earth alloy magnetic powder, the controlled atmosphere having a concentration of less than 100 ppm of an oxide gas comprised of at least one of oxygen and water; and (b) preparing said green compact by pressing the rare earth alloy magnetic powder with at least one organic additive under a magnetic field in a closed space having an atmosphere comprised of at least one inert gas, having a temperature ranging from 40° C.-45° C. and a relative humidity ranging from 20%-35% provide said green compact; and (c) sintering the green compact to provide said rare earth magnet.

* * * * *